US007513454B2

(12) United States Patent
Sullivan

(10) Patent No.: US 7,513,454 B2
(45) Date of Patent: Apr. 7, 2009

(54) DRAG-PRODUCING DEVICES

(75) Inventor: Christopher James Sullivan, Rickmansworth (GB)

(73) Assignee: Selex Sensors and Airborne Systems Limited, Basildon, Essex (GB)

( * ) Notice: Subject to any disclaimer, the term of this patent is extended or adjusted under 35 U.S.C. 154(b) by 393 days.

(21) Appl. No.: 10/507,077

(22) PCT Filed: Aug. 11, 2004

(86) PCT No.: PCT/GB2004/003469

§ 371 (c)(1),
(2), (4) Date: Sep. 9, 2004

(87) PCT Pub. No.: WO2005/026651

PCT Pub. Date: Mar. 24, 2005

(65) Prior Publication Data

US 2005/0178873 A1 Aug. 18, 2005

(30) Foreign Application Priority Data

Sep. 5, 2003 (EP) ..... 03255556
Sep. 5, 2003 (GB) ..... 0320896.4

(51) Int. Cl.
*B64C 25/68* (2006.01)

(52) U.S. Cl. ..... 244/1 TD; 244/110 R; 244/3.26

(58) Field of Classification Search ..... 244/3.26, 244/3.27, 110 R, 1 TD; 102/386, 388
See application file for complete search history.

(56) References Cited

U.S. PATENT DOCUMENTS 3,114,315 A 12/1963 Trump
3,861,627 A 1/1975 Schoffl
5,029,773 A 7/1991 Lecat
5,871,173 A * 2/1999 Frank et al. ..... 244/1 TD
2002/0079404 A1 6/2002 Schroeder et al.

FOREIGN PATENT DOCUMENTS

EP 0 768 508 A2 4/1997
EP 0 768 508 B1 7/2002
EP 1 314 952 A2 5/2003
FR 2 175 133 10/1973

* cited by examiner

*Primary Examiner*—J. Woodrow Eldred
(74) *Attorney, Agent, or Firm*—Buchanan Ingersoll & Rooney PC

(57) ABSTRACT

Described herein is a towed body (10) having a deployment mechanism (18, 20, 22, 28) for deploying a drag cone carried thereby. The towed body (10) comprises a body portion (12), a nose portion (14) and a tail portion (16). The deployment mechanism comprises a slider (20) mounted on the body portion (12) to which are pivotally mounted a plurality of forward opening blades (24). The slider (20) has a clip (22) mounted within it for locking the blades (24) in the fully deployed position. The slider (20) abuts a hub (18) for providing a surface on which the fluid acts as the towed body (10) is being towed therethrough. From a stowed position, fluid acting on the hub (18) forces the slider (20) and the blades (24) to move towards the tail portion (16). The blades (24) move up and over a bumper (28) located adjacent the tail portion (16) to deploy from the stowed position. When the blades (24) are fully deployed, the clip (22) engages with the body portion (12) to lock the blades (24) in position. In this position, the blades (24) substantially define a drag cone. Once the fully deployed position has been reached, the hub (18) is jettisoned to remove any unwanted turbulence.

50 Claims, 9 Drawing Sheets

DRAG-PRODUCING DEVICES

The present invention relates to improvements in or relating to drag-producing devices, and is more particularly concerned with the deployment of such devices.

Drag-producing devices are used to provide stability to a body being towed e.g. by an aircraft in flight. It is known to use a rigid cone for such a purpose. However, a cone of small diameter, which is suitable for stabilising a body being towed at high speed, is not ideally suited to low speed towing as it does not provide sufficient drag to stabilise the towed body against disturbances caused by induced oscillations propagated down the towing cable. Equally, a cone of large diameter which is suitable for the latter situation, can cause too much drag at high speed, which can place excessive strain on the towing cable.

U.S. Pat. No. 5,029,773 discloses a decoy having pivotably-mounted, drag-producing fins. The decoy is ejected from a canister and drag causes rapid extension of the fins to render the decoy aerodynamically stable. The sweepback angle of the fins, and hence the drag, is controlled by elastic restraints on the fins.

EP-A-0 768 508 discloses a drag-producing device which provides stability for a towed body. The device comprises a sleeve mounted on the body to which is attached a plurality of drag-producing blades. One end of each blade is pivotably attached to a portion of the sleeve with the other end of each blade lying on a circle and extending forwardly over the towed body prior to deployment. The sleeve rests against a spring. When the towed body is deployed, the experienced drag force acts on the free ends of the blades and causes each blade to pivot about its attachment point to the sleeve. The drag force also causes the sleeve to move forwardly against the force of the spring as the drag force acting on the blades increases. This movement of the sleeve against the spring has the effect of reducing the diameter of the circle on which the free ends of the blades lie and hence the drag force experienced by the towed body. Moreover, as a result of this movement, the cross-sectional area of the cone defined by the blades becomes variable. This enables the device to produce the optimum amount of drag for the particular circumstances of towing. In this particular case, the drag cone is described as rear opening as the blades open about a rear hinge position.

However, it will be appreciated during deployment of the blades from the stowed position to a deployed position, the free ends of the blades are rotated about their pivot point through an angle in excess of 90°. At some towing speeds, this rotation may cause one or more of the blades to become damaged and therefore the effectiveness of the cone which they define is substantially reduced.

It is therefore an object of the present invention to provide a drag-producing body which has an improved deployment mechanism.

In accordance with one aspect of the present invention, there is provided a towed body comprising:

- a body portion;
- a support member mounted on the body portion, the support member being movable with respect to the body portion in a generally rearward direction along a section thereof;
- a plurality of forward opening blades pivotally mounted on the support member and lying adjacent the body portion in a stowed position, the blades defining a drag cone when in a fully deployed position; and
- a deployment mechanism associated with the support member for causing movement in the generally rearward direction, the deployment mechanism including ramp means for deploying the blades and locking means for locking the blades in the fully deployed position.

Advantageously, the deployment mechanism includes surface means associated with the support member for effecting movement in the generally rearward direction.

In one embodiment of the present invention, the surface means is mounted on the support member. In an alternate embodiment, the surface means abuts the support member. In this case, the surface means comprises a hub member releasably mounted on the body portion.

The hub member may comprise at least two interlocking hub portions. In one arrangement, each hub portion comprises at least two moveable sections, each section being extendable in a generally radial direction away from the body portion. Alternatively, each hub portion may have a front face, the front face including a plurality of recesses formed therein.

In another embodiment of the present invention, the surface means comprises a plurality of rear opening blades, the rear opening blades lying in a stowed position along the body portion and opening to form a generally disc-shaped surface in their deployed position. In this case, the rear opening blades may fold rearwards from their deployed position, may be jettisoned or may remain in their deployed position when the forward opening blades are fully deployed.

Preferably, the rear opening blades are substantially shorter than the forward opening blades.

Advantageously, the deployment mechanism further includes guide means for guiding the movement of the support member in the generally rearward direction. It is preferred that the guide means includes at least two slots formed in the body portion and pins attached to the hub member, the pins sliding in the slots along the body portion.

Most advantageously, the slots include run-outs at a rearward end thereof for effecting release of the hub member.

Preferably, the locking means comprises a snap ring mounted in the support member, the snap ring engaging with a groove formed in the body portion. The groove may be formed adjacent the run-out.

Additionally, the relative positions of the groove and the ramp means and of the locking means and the pivotal mounting for the blades on the support member together define the diameter of the drag cone formed by the fully deployed forward opening blades.

For a better understanding of the present invention, reference will now be made, by way of example only, to the accompanying drawings in which.

Components which are identical in each of the Figures to be described below are referenced the same.

The drag cone arrangement of the present invention is described as being 'forward opening' as the blades open about a forward hinge position.

Figure 1:
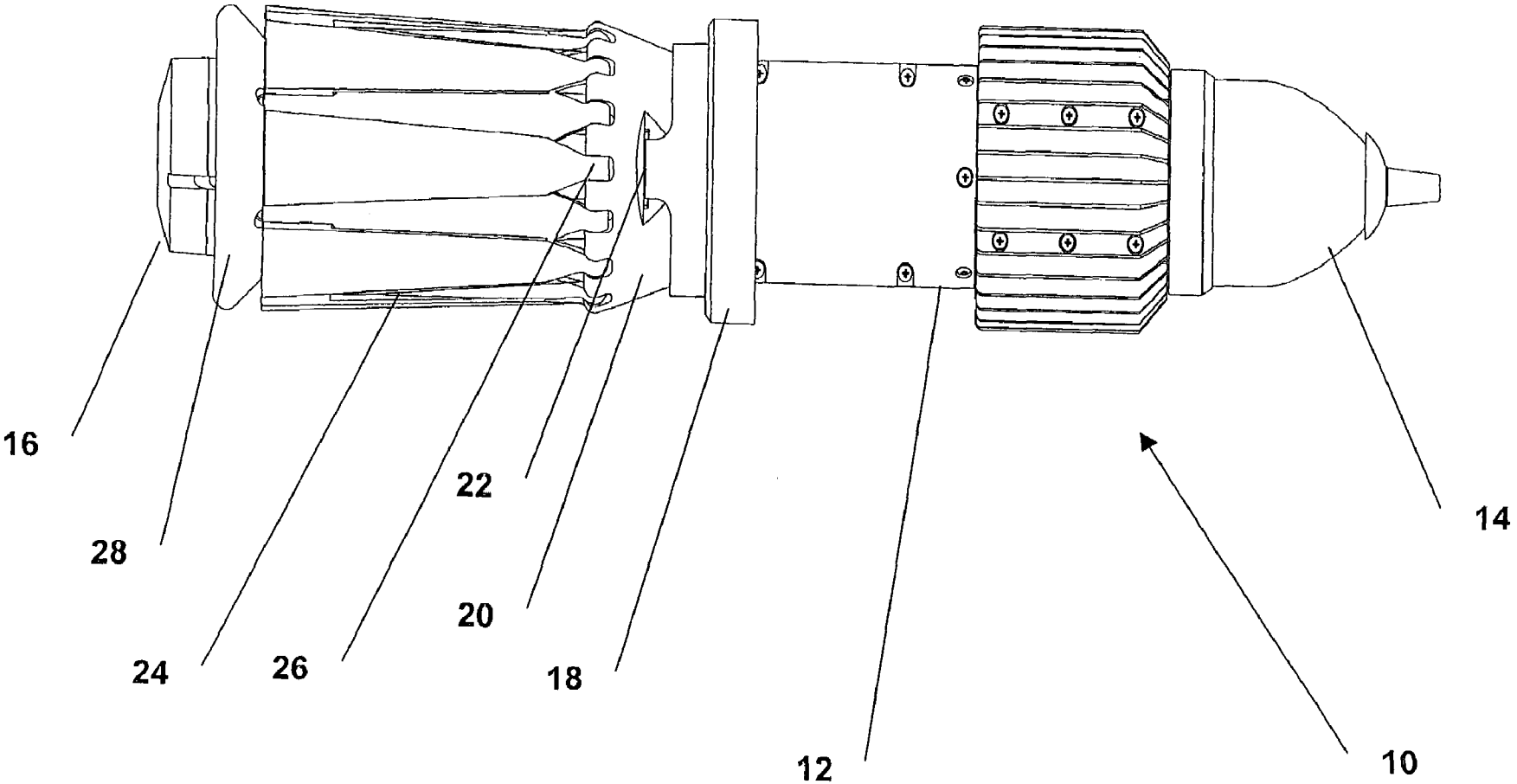
FIG. 1 illustrates a side view of a towed body showing a stowed deployable cone arrangement in accordance with the present invention.

Referring initially to FIG. 1, a towed body 10 is shown. The body 10 comprises a central body portion 12, a nose or forward portion 14 and a tail or rearward portion 16. Mounted on the central body portion 12 is an annular hub 18 which abuts one end of an annular slider 20. The slider 20 carries a clip 22 within an annular groove (not shown) formed in its interior surface (also not shown) which lies adjacent the surface of the body portion 12. The clip 22 may be in the form of a snap ring or large circlip.

Whilst the hub 18 abuts the slider 20, there is no rigid connection between them and the hub 18 and slider 20 can move together or independently of one another.

The relationship between the slider 20 and the annular hub 18 is described in more detail with reference to FIG. 9.

Connected to the other end of the annular slider 20 is a plurality of blades 24—only seven of which can be seen in FIG. 1. Each blade 24 is pivotably mounted to the slider 20 at 26 as shown. Rearward of the blades 24 is an annular bumper 28 which is generally conical in shape.

The blades 24, when fully deployed, form a drag cone arrangement whose half angle is defined by the bumper 28. In the particular embodiment illustrated, the drag cone arrangement consists of sixteen individual blades 24.

Figure 2:
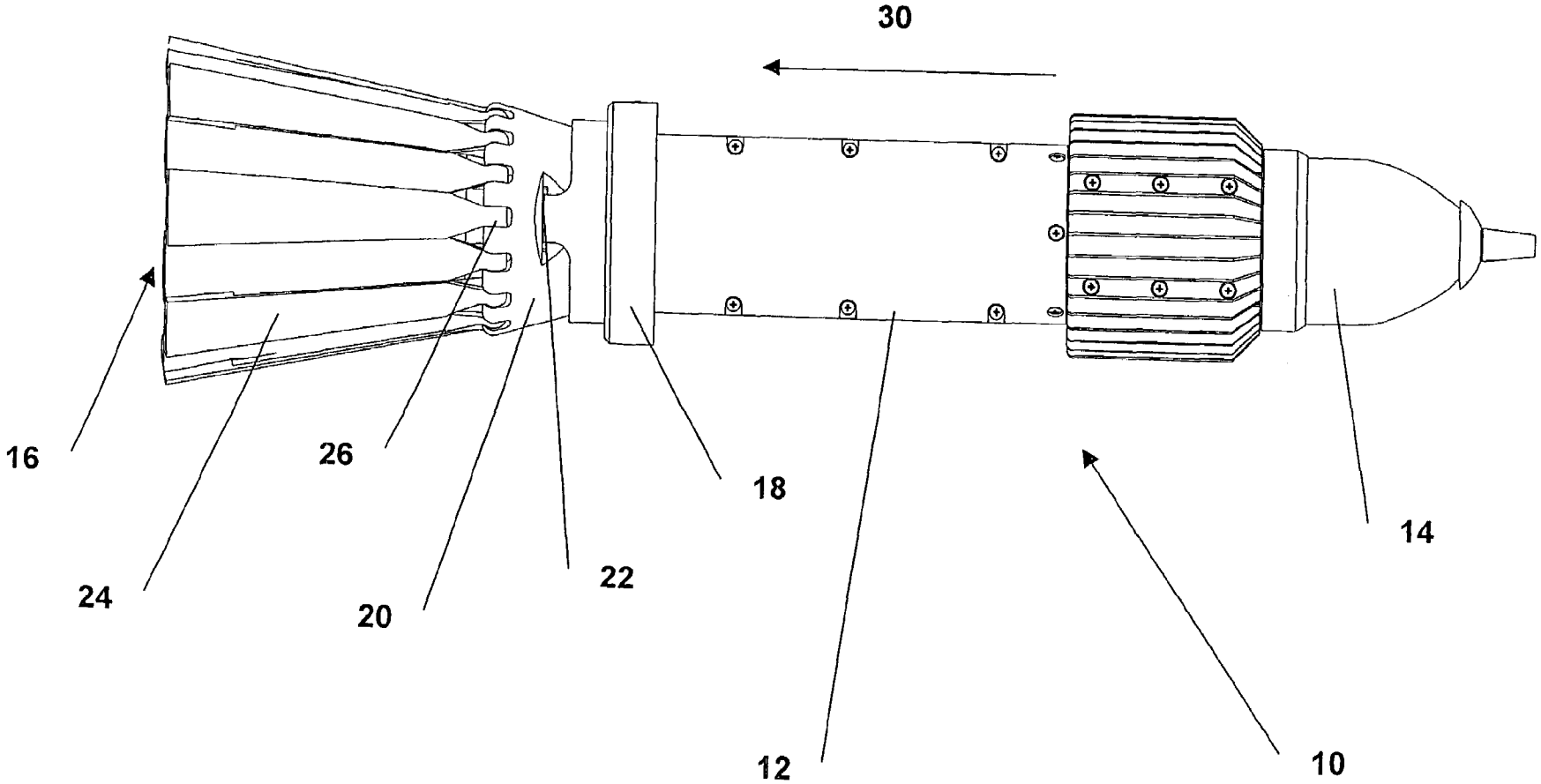
FIG. 2 illustrates a side view of the towed body of FIG. 1 with a partially deployed deployable cone arrangement.
Figure 3:
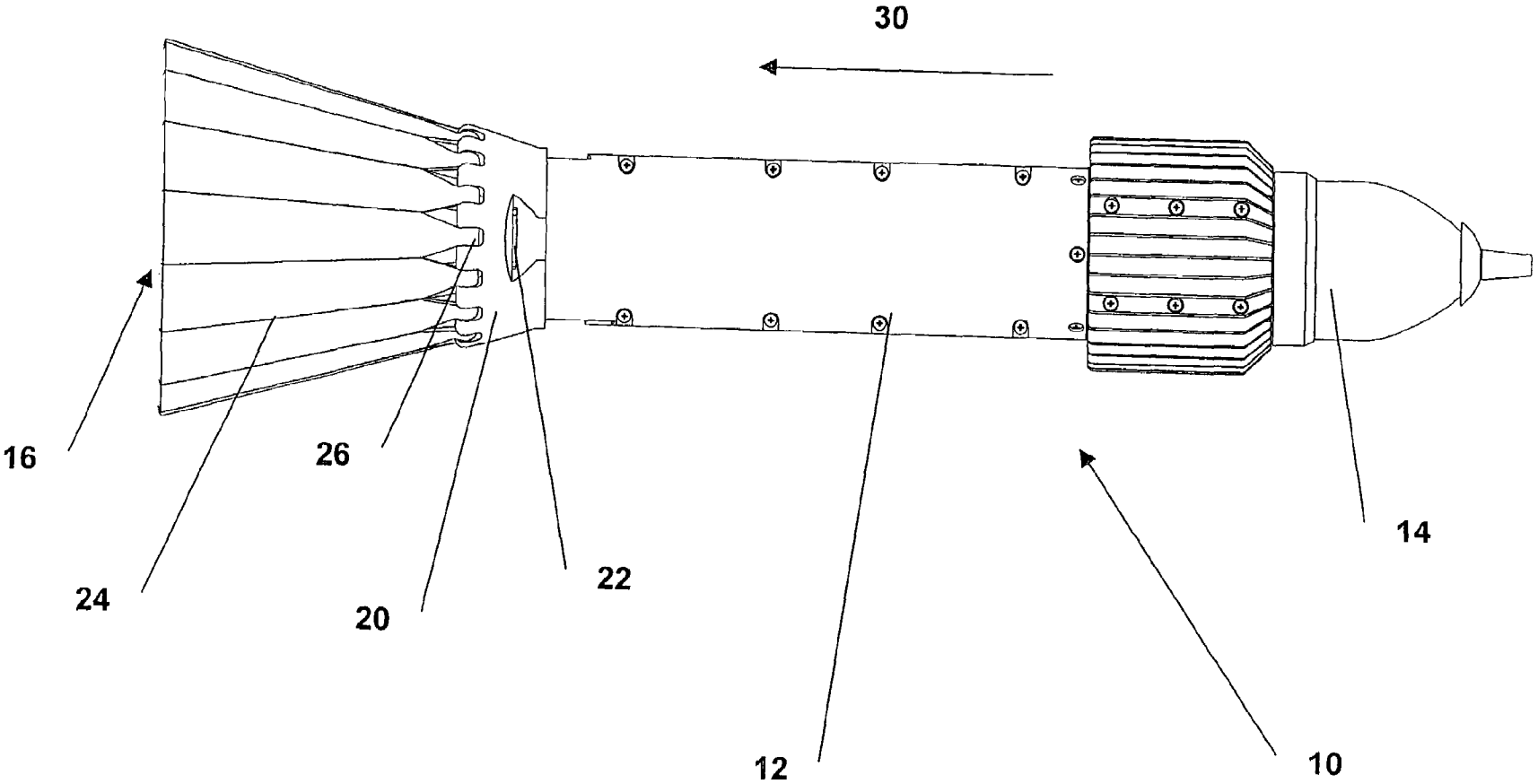
FIG. 3 illustrates a side view of the towed body of FIG. 1 with a fully deployed deployable cone arrangement.

To effect deployment of the drag cone arrangement as shown in FIGS. 2 and 3, the hub 18, slider 20, clip 22 and blades 24 slide over the central body portion 12 from a forward position (as shown in FIG. 1) to a rearward position (as shown in FIG. 3). Deployment of the drag cone arrangement will be described in more detail below.

In the stowed position as shown in FIG. 1, the towed body 10 can be stored in any suitable container (not shown) prior to deployment. Naturally, such a container is located on a vehicle (also not shown) which will tow the towed body 10 after launch into a fluid. Moreover, it will readily be understood that the towed body 10 will be connected to the vehicle for towing by a cable or any other suitable means (not shown) connected to its nose portion 12.

It will be appreciated that the cable or other suitable towing means need not be connected to the nose portion 12 and may be connected to the towed body 10 at any other suitable point. For example, the towing means may be connected to a point located at or near the centre of gravity of the towed body 10.

By the term "fluid" is meant any medium through which a vehicle can move towing a body behind it, for example, air or water.

Figure 4:
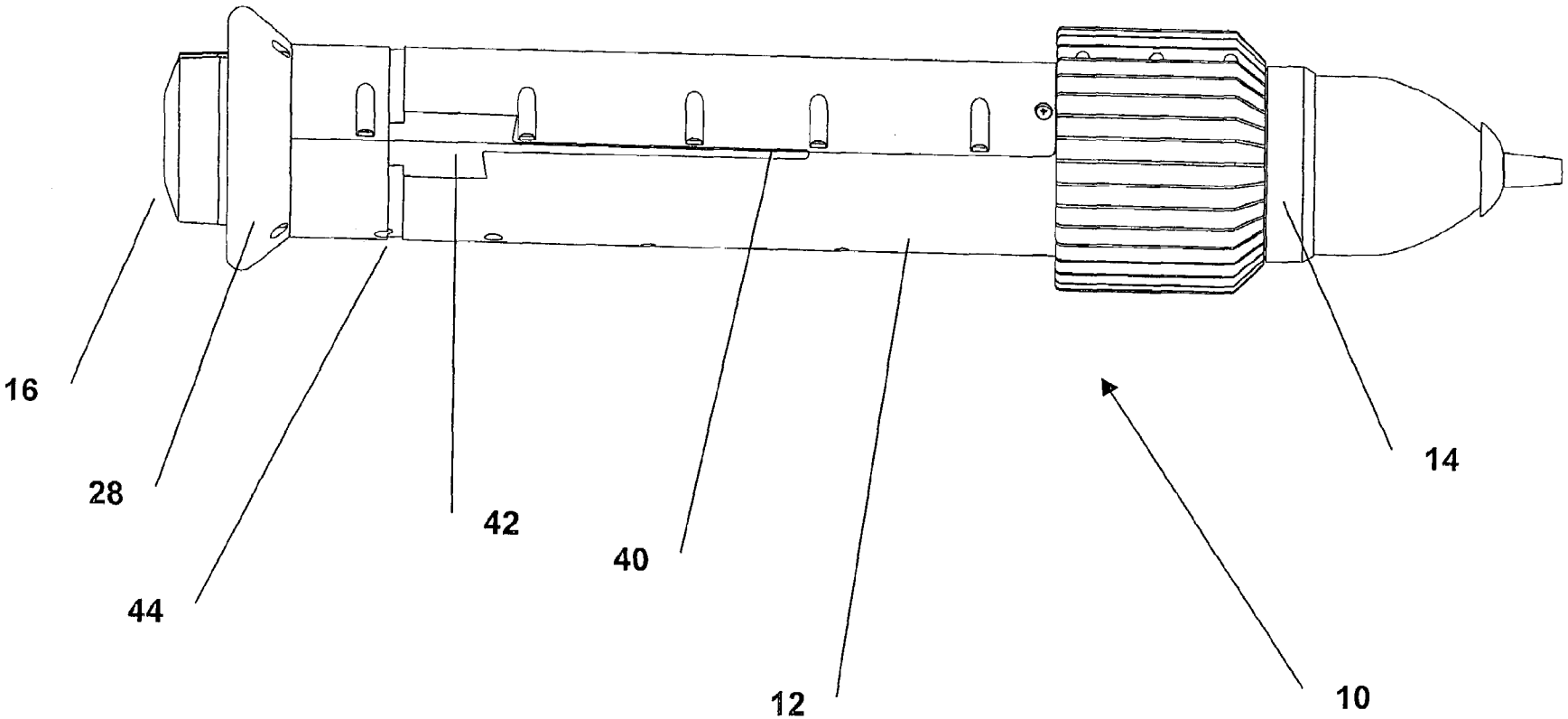
FIG. 4 illustrates a side view of the towed body of FIGS. 1 to 3 with the deployable cone arrangement removed.

Once the towed body 10 has been launched from its container, the fluid acts on the hub 18 to push it, and the abutting slider 20, clip 22 and blades 24, in a rearward direction towards the tail portion 16 as indicated by arrow 30 in FIG. 2. As the hub 18 is pushed in the rearward direction indicated by arrow 30, pins 70 (FIG. 9) attached to the inner surface of the hub 18 slide in slot 40 (FIG. 4). This causes the slider 20 to slide over the body portion 12 pushing the blades 24 up over the bumper 28. The pivotal connection 26 of each blade 24 to the slider 20 allows the blades 24 to move away from the body portion 12 and up over the bumper 28 to form the required drag cone arrangement.

As the fluid pushes the hub 18, and the slider 20, clip 22 and blades 24 connected to it, in the rearward direction as indicated by arrow 30 (FIG. 2). The pins 70 on the hub 18 slide in slot 40 until run-out portion 42 formed at the end of slot 40 (FIG. 4) is reached. At this point, the pins 70 are no longer retained and the hub 18 is released and jettisoned to prevent any unwanted turbulence affecting the deployed drag cone arrangement.

In order to effect successful jettisoning of the hub 18, the hub 18 is designed to comprise two or more hub portions (not shown) which are held together by the location of the pins 70 in the slot 40. Once the pins 70 leave the slot 40 and enter the run-out 42, the hub portions are released allowing them to be jettisoned. Once this point is reached, the clip 22 is aligned with annular groove 44 (FIG. 4) formed at the end of the run-out 42 and engages therewith. This engagement locks the slider 20 and blades 24 in position with the drag cone arrangement fully deployed.

In FIG. 4, the towed body 10 is shown with the drag cone arrangement removed. This is so the slot 40, run-out 42 and groove 44 can be seen in more detail. Although only one slot 40, run-out 42 and groove 44 arrangement is shown in FIG. 4, it will readily be understood that an identical slot, run-out and groove arrangement is also provided diametrically opposite to the one illustrated.

It will readily be appreciated that in the stowed position, the drag cone arrangement sits close to the body portion 12 of the towed body 10 allowing the body 10 to be stored in a minimum amount of space. In this position, the blades 24 overlap one another as shown in FIG. 1. In the fully deployed position as shown in FIG. 3, the blades 24 form a continuous cone which has a base diameter which is greater than the diameter of the body portion 12.

Whilst the blades 24 are shown abutting one another in FIG. 3, it will readily be understood that the blades 24 may still overlap one another by small amount. Naturally, the base diameter can be varied according to the particular application. However, it may not be necessary that the blades 24 overlap when fully deployed if the application allows.

Figure 5:
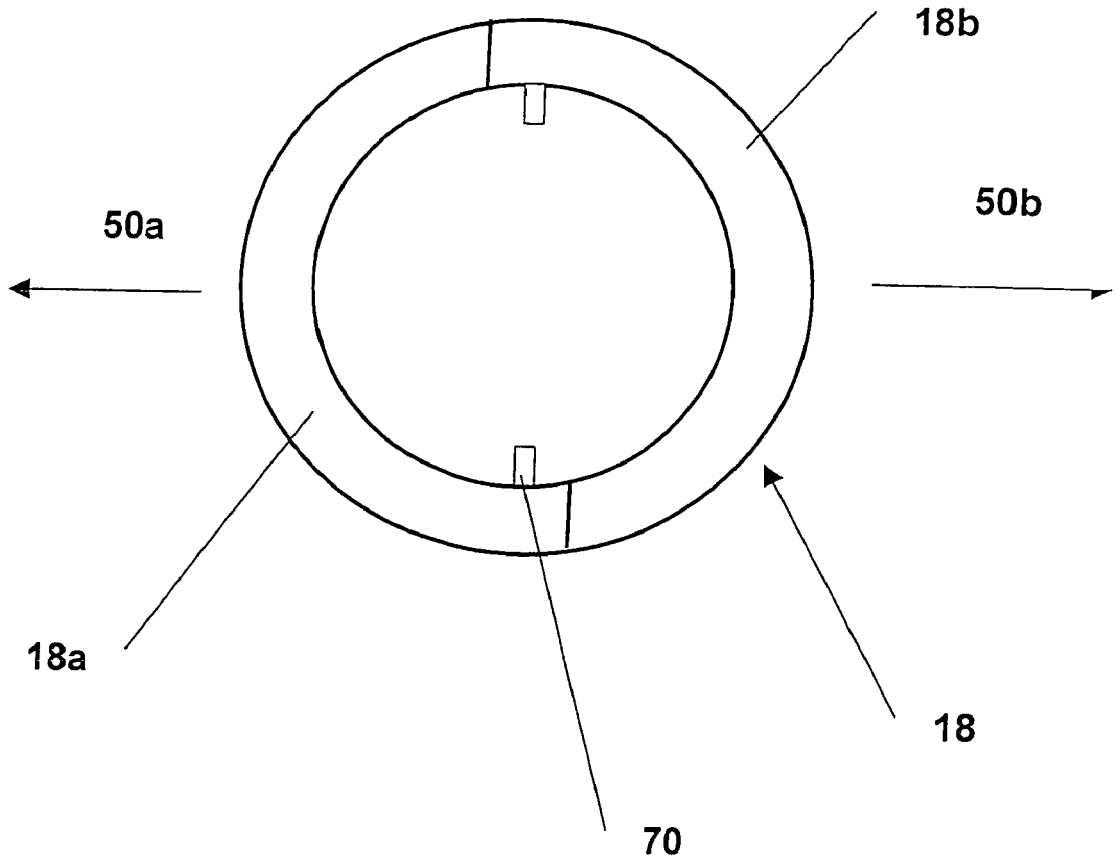
FIG. 5 illustrates an end view of one deployment mechanism of the deployable cone arrangement.

FIG. 5 illustrates one embodiment of a hub 18 in accordance with the present invention. The hub 18 comprises two hub portions 18*a*, 18*b* as shown which, when released by the pins 70, separate outwards as indicated by arrows 50*a*, 50*b*. Although in this embodiment, the hub 18 has two hub portions, it will be appreciated that any other suitable number of hub portions can be utilised according to the particular application.

Figure 6:
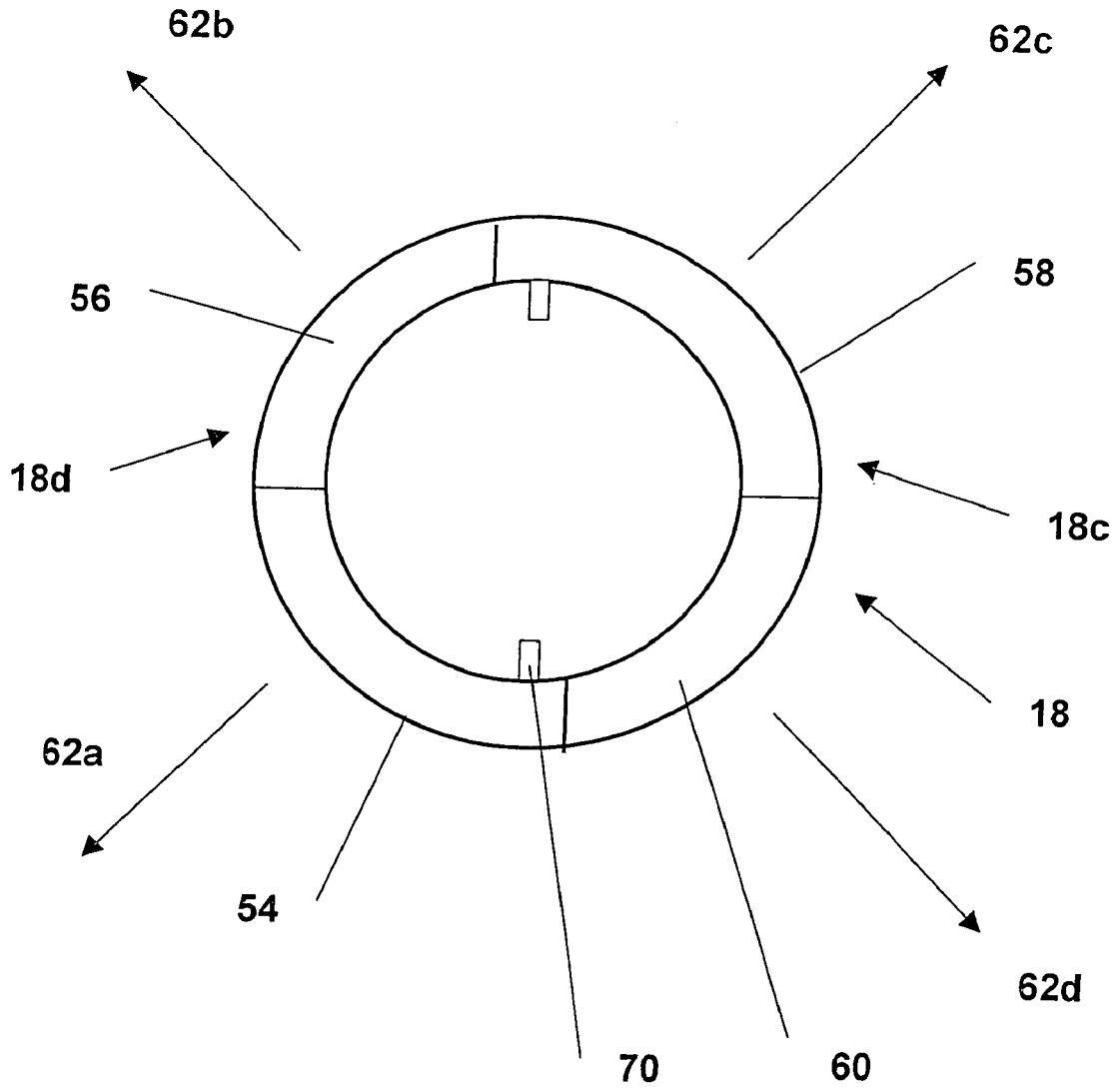
FIG. 6 illustrates an end view of a second deployment mechanism of the deployable cone arrangement.

In another embodiment of the hub 18, shown in FIG. 6, there are still two hub portions 18*c*, 18*d* as shown. However, hub portion 18*c* is divided into two sections 54, 56 and hub portion 18*d* is divided into two sections 58, 60. In this embodiment, prior to release by the pins 70, sections 54, 56, 58, 60 are mounted so as to slide in respective radial directions 62*a*, 62*b*, 62*c*, 62*d* to increase the area against which the fluid pushes.

It will be understood that any suitable slidable mounting arrangement can be used to extend the sections 54, 56, 58, 60 in the radial directions 62*a*, 62*b*, 62*c*, 62*d*. For example, the sections 54, 56, 58, 60 may comprise segments having a raised external rim, each segment having two or more slots formed therein by which the segment is mounted on screws or the like attached to the body of the hub 18.

Figure 7:
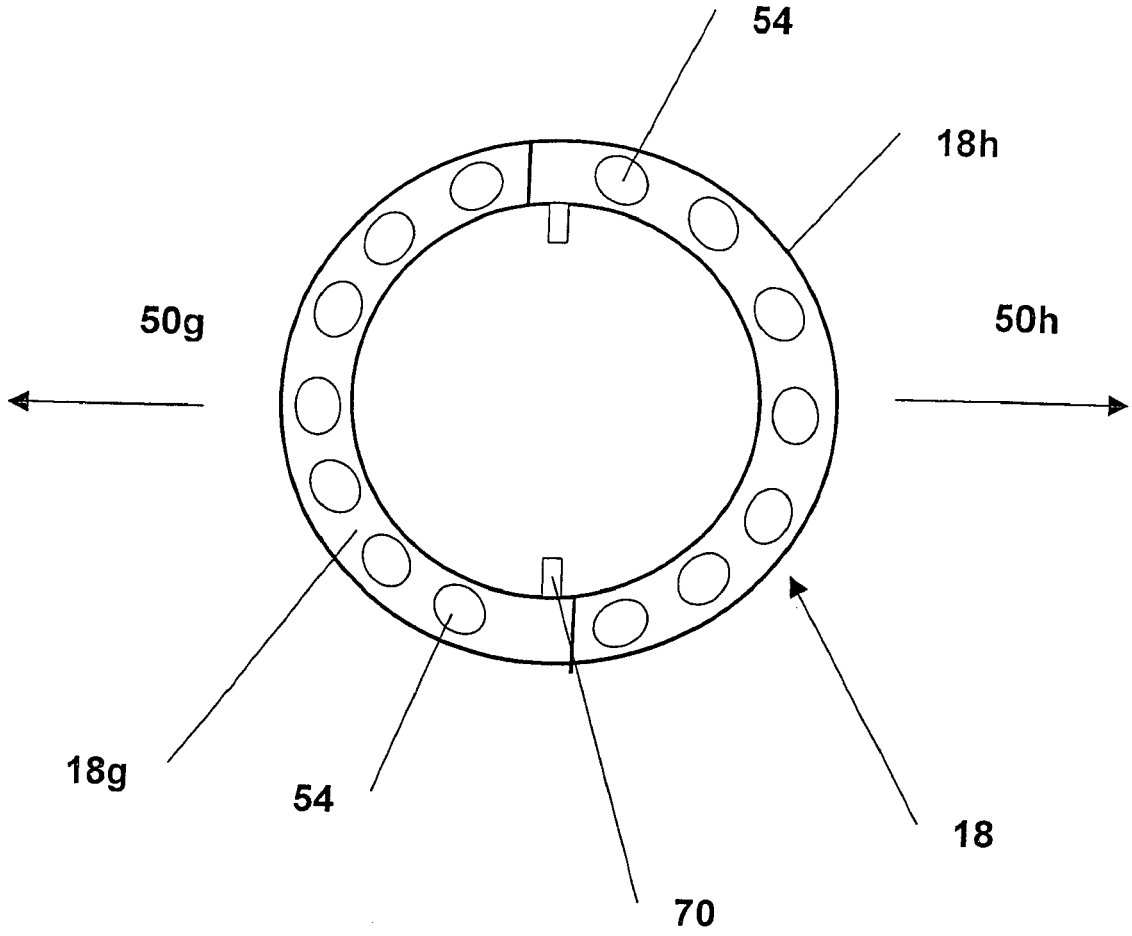
FIG. 7 illustrates an end view of a third deployment mechanism of the deployable cone arrangement.

Alternatively, as shown in FIG. 7, the hub 18 may have an annular surface which includes a plurality of 'pockets' or recesses to increase the surface area which is in contact with the fluid. In this embodiment, the hub 18 has two hub portions 18*g*, 18*h* which are similar to hub portions 18*a*, 18*b* and will separate as indicated by arrows 50*g*, 50*h* when released by the pins 70.

Here, the hub portions 18*g*, 18*h* do not extend radially but include a plurality of recesses 64 as shown. Seven recesses 64 are shown in each hub portion 18*g*, 18*h* but other numbers of recesses are also possible. Moreover, although the recesses 64 are shown as being substantially elliptical and substantially equally spaced within the respective hub portion 18*g*, 18*h*, any other suitable shape and configuration can be implemented.

In another embodiment of the present invention (not illustrated), the hub 18 can be replaced by a plurality of rear opening mini-blades which form a disc when deployed. In this case, the mini-blades are hinged to the slider 20 at their rearward end with their free ends facing forward and the clip 22 within the slider 20 runs over the surface of the body portion 12.

Fluid passing over the towed body, opens the mini-blades to form the disc. The force acting on the disc so formed causes the slider 20 to move rearwards pushing the blades 24 up over the bumper 28 and into the fully deployed position. Once fully deployed, the mini-blades can either remain in the disc formation, be folded rearwards or be jettisoned according to the particular requirement.

It will be appreciated that, in this embodiment, the force created by the fluid on the mini-blades to force the disc rearwards will be sufficient to overcome any friction between the clip 22 and the surface of the body portion 12 over which the slider 20 moves.

In an alternate embodiment (also not illustrated), the mini-blades may be mounted on the hub 18 and are jettisoned with the hub 18 once the blades 24 are fully deployed and locked in place.

It will be appreciated that the term 'mini-blade' is intended to mean a blade which is substantially shorter than the blade 24 forming the drag cone. Preferably, the ratio of the length of a mini-blade to the length of a blade 24 falls in a range of between 1:4 and 1:12 depending on the particular application. The reason for this blade to be substantially shorter as, if the disc formed by such blades remains in place after the drag cone has been deployed, no undesirable effects due to turbulence are experienced.

Figure 8:
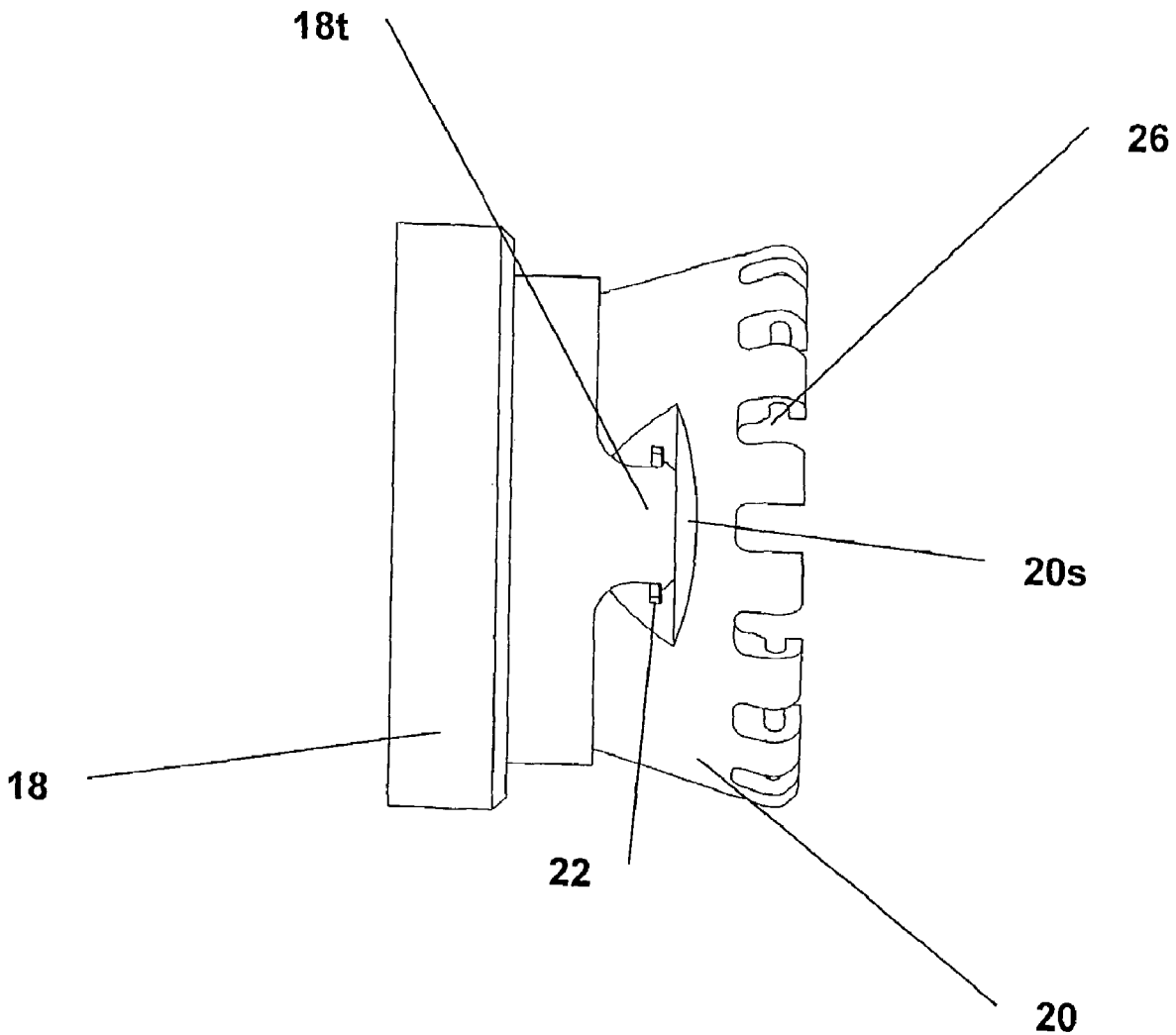
FIG. 8 illustrates a portion of the towed body of FIG. 1 in more detail.

In FIG. 8, a more detailed view of the hub 18, slider 20 (with no blades 24 attached) and clip 22 is shown. It is to be noted that, although the hub 18 and slider 20 abut one another, the clip 22 can be connected to a portion of the hub 18. As shown, the hub 18 has a tongue portion 18*t* and the slider 20 has a slot portion 20*s*, the tongue portion 18*t* fitting within the slot portion 20*s*. As described above, the slider 20 carries the clip 22 in a groove. As the clip 22 may be sprung, for example, a snap ring or circlip, the ends of the clip 22 need to be held apart to eliminate friction between the body portion 12 and the clip 22 as the slider 20 moves in the rearward direction. In this particular case, the tongue portion 18*t* operates to hold the ends of the clip 22 apart until the blades 24 have been fully deployed and the hub 18 has been released and jettisoned. It will be understood that, once the hub 18 has been jettisoned, the ends of the clip 22 are then free to snap into groove 44 (FIG. 4).

It will be understood that the spacing of the end of the tongue portion 18*t* to the positions of the pins 70 is chosen such that the clip 22 is over the groove 44 (FIG. 4) when the hub 18 is about to be released and jettisoned.

It will be appreciated that whilst the hub 18 may have a tongue portion 18*t* and the slider 20 may have a slot portion 20*s*, it may not be necessary for the tongue portion 18*t* to hold the ends of the clip 22 apart. This may be the case in situations where the friction between the clip 22 and the body portion 12 is readily overcome by the force of the fluid on the hub 18.

Figure 9:
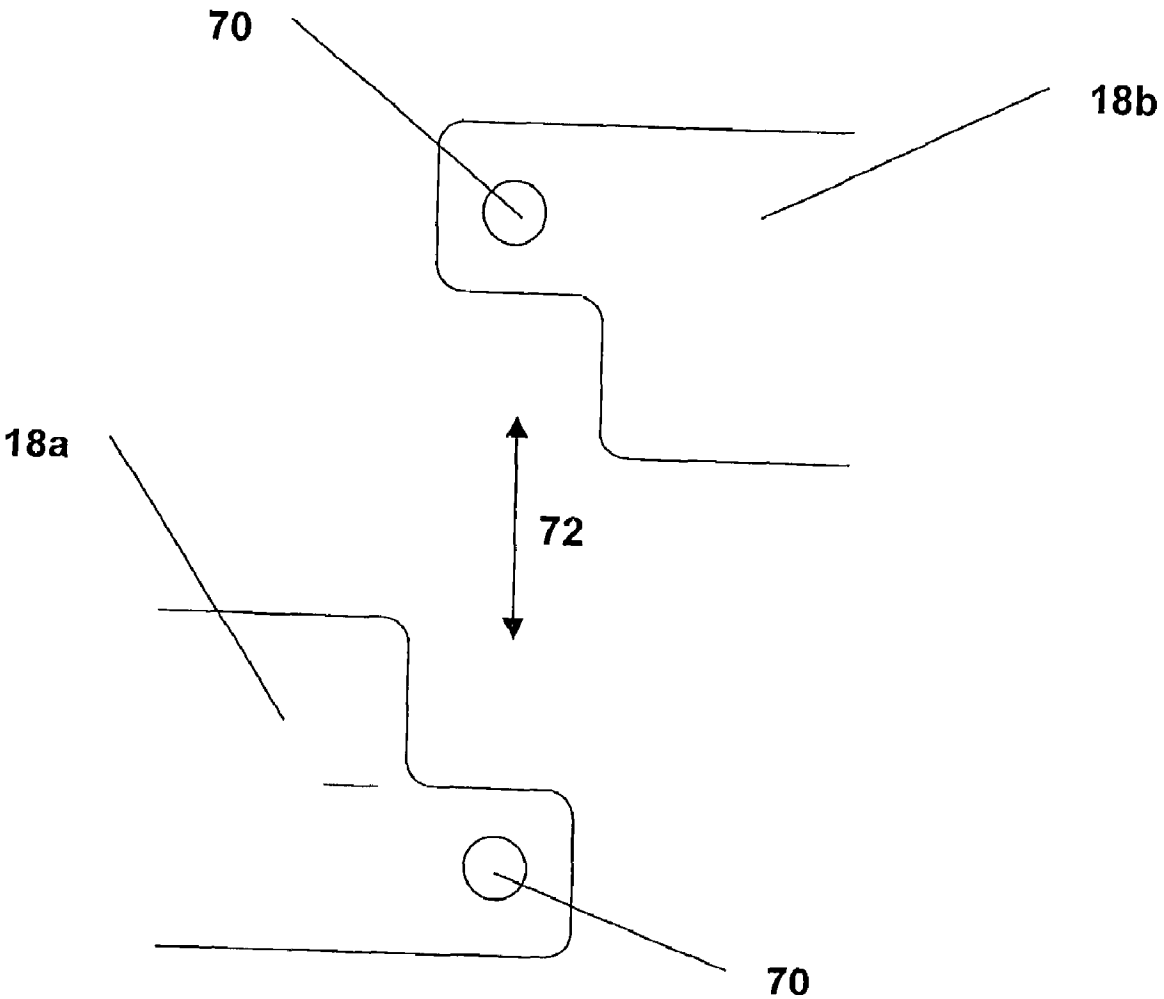
FIG. 9 illustrates a portion of the deployment mechanisms of FIGS. 5 to 7 in more detail.

In FIG. 9, two hub portions 18*a*, 18*b* are shown. For ease of manufacture, each hub portion 18*a*, 18*b* is identical with one end of each hub portion having an end as shown for hub portion 18*a* and the other end as shown for hub portion 18*b*. This means that rotating one hub portion with respect to another and bringing the free ends together, as indicated by arrow 72, a complete hub 18 is formed. As shown, a pin 70, as discussed above, is formed at the free end of each hub portion 18*a*, 18*b*.

When the two hub portions 18*a*, 18*b* are put together and assembled over the body portion 12, the pins 70, when in slot 40, hold the hub portions 18*a*, 18*b* together to form the hub 18.

Although FIG. 9 only shows two hub portions 18*a*, 18*b*, it will be appreciated that if the hub 18 comprises more than two hub portions, each hub portion will be identical and the body portion 12 will include additional slots 40 as required. For example, if there are three hub portions, three slots 40 will need to be provided on body portion 12, each slot being spaced at 120° apart around the circumference of the body portion 12.

The blades 24 may be made of any suitable material. In applications where rigidity is an issue, metallic materials are preferred. However, where rigidity is not an issue, or if components are located in the tail portion 16 which may be compromised by the presence of a metallic material, non-metallic materials such as polycarbonate or glass fibre can be used. Naturally, the mini-blades can be made from the similar materials as the blades 24.

The invention claimed is:

1. A towed body comprising:

a body portion;

a support member mounted on the body portion, the support member being movable with respect to the body portion in a generally rearward direction along a section thereof;

a plurality of forward opening blades pivotally mounted on the support member and lying adjacent the body portion in a stowed position, the blades defining a drag cone when in a fully deployed position; and a deployment mechanism associated with the support member for causing movement in the generally rearward direction, the deployment mechanism including ramp means for deploying the blades, locking means for locking the blades in the fully deployed position, and surface means for effecting movement in the generally rearward direction based on an action of fluid, in which the towed body is stowed, on the surface means.

2. A towed body according to claim 1 wherein the surface means is associated with the support member.

3. A towed body according to claim 2 wherein the surface means is mounted on the support member.

4. A towed body according to claim 2, wherein the surface means abuts the support member.

5. A towed body according to claim 4, wherein the surface means comprises a hub member releasably mounted on the body portion.

6. A towed body according to claim 5, wherein the hub member comprises at least two interlocking hub portions.

7. A towed body according to claim 6, herein each hub portion includes at least two moveable sections, each section being extendable in a generally radial direction away from the body portion.

8. A towed body according to claim 6, wherein each hub portion has a front face, the front face including a plurality of recesses formed therein.

9. A towed body according to claim 7, wherein each hub portion has a front face, the front face including a plurality of recesses formed therein.

10. A towed body according to claim 2, wherein the surface means comprises a plurality of rear opening blades, the rear opening blades lying in a stowed position along the body portion and opening to form a generally disc-shaped surface in their deployed position.

11. A towed body according to claim 10, wherein the rear opening blades fold rearwards from their deployed position when the forward opening blades are fully deployed.

12. A towed body according to claim 9, wherein the rear opening blades fold rearwards from their deployed position when the forward opening blades are fully deployed.

13. A towed body according to claim 10, wherein the rear opening blades fold rearwards from their deployed position when the forward opening blades are fully deployed.

14. A towed body according to claim 12, wherein the rear opening blades are substantially shorter than the forward opening blades.

15. A towed body according to claim 3, wherein the surface means comprises a plurality of rear opening blades, the rear opening blades lying in a stowed position along the body portion and opening to form a generally disc-shaped surface in their deployed position.

16. A towed body according to claim 15, wherein the rear opening blades fold rearwards from their deployed position when the forward opening blades are fully deployed.

17. A towed body according to claim 15, wherein the rear opening blades are jettisoned from their deployed position when the forward opening blades are fully deployed.

18. A towed body according to claim 15, wherein the rear opening blades remain in their deployed position when the forward opening blades are fully deployed.

19. A towed body according to claim 15, wherein the rear opening blades are substantially shorter than the forward opening blades.

20. A towed body according to claim 4, wherein the surface means comprises a plurality of rear opening blades, the rear opening blades lying in a stowed position along the body portion and opening to form a generally disc-shaped surface in their deployed position.

21. A towed body according to claim 20, wherein the rear opening blades fold rearwards from their deployed position when the forward opening blades are fully deployed.

22. A towed body according to claim 20, wherein the rear opening blades are jettisoned from their deployed position when the forward opening blades are fully deployed.

23. A towed body according to claim 20, wherein the rear opening blades remain in their deployed position when the forward opening blades are fully deployed.

24. A towed body according to claim 20, wherein the rear opening blades are substantially shorter than the forward opening blades.

25. A towed body according to claim 5, wherein the surface means comprises a plurality of rear opening blades, the rear opening blades lying in a stowed position along the body portion and opening to form a generally disc-shaped surface in their deployed position.

26. A towed body according to claim 25, wherein the rear opening blades fold rearwards from their deployed position when the forward opening blades are fully deployed.

27. A towed body according to claim 25, wherein the rear opening blades are jettisoned from their deployed position when the forward opening blades are fully deployed.

28. A towed body according to claim 25, wherein the rear opening blades remain in their deployed position when the forward opening blades are fully deployed.

29. A towed body according to claim 25, wherein the rear opening blades are substantially shorter than the forward opening blades.

30. A towed body according to claim 6, wherein the surface means comprises a plurality of rear opening blades, the rear opening blades lying in a stowed position along the body portion and opening to form a generally disc-shaped surface in their deployed position.

31. A towed body according to claim 30, wherein the rear opening blades fold rearwards from their deployed position when the forward opening blades are fully deployed.

32. A towed body according to claim 30, wherein the rear opening blades are jettisoned from their deployed position when the forward opening blades are fully deployed.

33. A towed body according to claim 30, wherein the rear opening blades remain in their deployed position when the forward opening blades are fully deployed.

34. A towed body according to claim 30, wherein the rear opening blades are substantially shorter than the forward opening blades.

35. A towed body according to claim 4, wherein the deployment mechanism further includes guide means for guiding the movement of the support member in the generally rearward direction.

36. A towed body according to claim 35, wherein the guide means includes at least two slots formed in the body portion and pins attached to the hub member, the pins sliding in the slots along the body portion.

37. A towed body according to claim 36, wherein the slots include run-outs at a rearward end thereof for effecting release of the hub member.

38. A towed body according to claim 37, wherein the locking means comprises a snap ring mounted in the support member, the snap ring engaging with a groove formed in the body portion.

39. A towed body according to claim 38, wherein the groove is formed adjacent the run-out.

40. A towed body according to claim 39, wherein the relative positions of the groove and the ramp means and of the locking means and the pivotal mounting for the blades on the support member together define the diameter of the drag cone formed by the fully deployed forward opening blades.

41. A towed body according to claim 5, wherein the deployment mechanism further includes guide means for guiding the movement of the support member in the generally rearward direction.

42. A towed body according to claim 41, wherein the guide means includes at least two slots formed in the body portion and pins attached to the hub member, the pins sliding in the slots along the body portion.

43. A towed body according to claim 42, wherein the slots include run-outs at a rearward end thereof for effecting release of the hub member.

44. A towed body according to claim 9, wherein the deployment mechanism further includes guide means for guiding the movement of the support member in the generally rearward direction.

45. A towed body according to claim 44, wherein the guide means includes at least two slots formed in the body portion and pins attached to the hub member, the pins sliding in the slots along the body portion.

46. A towed body according to claim 45, wherein the slots include run-outs at a rearward end thereof for effecting release of the hub member.

47. A towed body according to claim 46, wherein the locking means comprises a snap ring mounted in the support member, the snap ring engaging with a groove formed in the body portion.

48. A towed body according to claim 47, wherein the groove is formed adjacent the run-out.

49. A towed body according to claim 48, wherein the relative positions of the groove and the ramp means and of the locking means and the pivotal mounting for the blades on the support member together define the diameter of the drag cone formed by the fully deployed forward opening blades.

50. A towed body according to claim 1, wherein the locking means comprises a snap ring mounted in the support member, the snap ring engaging with a groove formed in the body portion.

* * * * *